US007560630B1

(12) United States Patent
Keenan, Jr.

(10) Patent No.: US 7,560,630 B1
(45) Date of Patent: Jul. 14, 2009

(54) MULTIFUNCTIONAL HEADSTOCK SUPPORT FOR STRING INSTRUMENTS

(76) Inventor: Lionel M. Keenan, Jr., P.O. Box 248, Gauley Bridge, WV (US) 25085

( * ) Notice: Subject to any disclaimer, the term of this patent is extended or adjusted under 35 U.S.C. 154(b) by 0 days.

(21) Appl. No.: 11/879,661

(22) Filed: Jul. 18, 2007

(51) Int. Cl.
*G10D 3/00* (2006.01)

(52) U.S. Cl. ..... 84/327; 84/290

(58) Field of Classification Search ..... 84/327, 84/290

See application file for complete search history.

(56) References Cited

U.S. PATENT DOCUMENTS

| | | | | |
|---|---|---|---|---|
| 3,329,054 | A | 7/1967 | Faillaci | |
| 5,197,701 | A | 3/1993 | Olson | |
| 6,096,954 | A * | 8/2000 | Hatfield | 84/329 |
| 6,515,209 | B2 * | 2/2003 | Pittman | 84/453 |
| 6,600,096 | B2 | 7/2003 | Jarvis | |
| 6,747,197 | B2 | 6/2004 | Kellogg | |

* cited by examiner

*Primary Examiner*—Jeffrey Donels
*Assistant Examiner*—Christopher Uhlir

(57) ABSTRACT

A multifunctional headstock support for stringed instruments; guitars, banjos, and the like, comprises a first constituent defining an anchorage base and a hingedly-coupled second constituent forming a sub-support appendage. The anchorage base comprises an integral mounting plate made from a substantially resilient material such as spring metal or a plastic, predetermined dimensions and geometrical shape sufficient to permit direct attachment to a predetermined back side portion of a string instrument's headstock. The sub-support appendage comprises an elongated support member which may employ a plurality of elongated support legs or a singular elongated support leg. Support leg(s) being sufficiently dimensioned to impart an increased planar surface-to-tuning machine knobs clearance under the headstock, and of sufficiently robust construction to support the headstock and associated weight of a string instrument when instrument is placed in either a reclined or inclined position. Thusly, the sub-support appendage is unitarily coupled with and suspended from the anchorage base through a substantial hinging means.

19 Claims, 14 Drawing Sheets

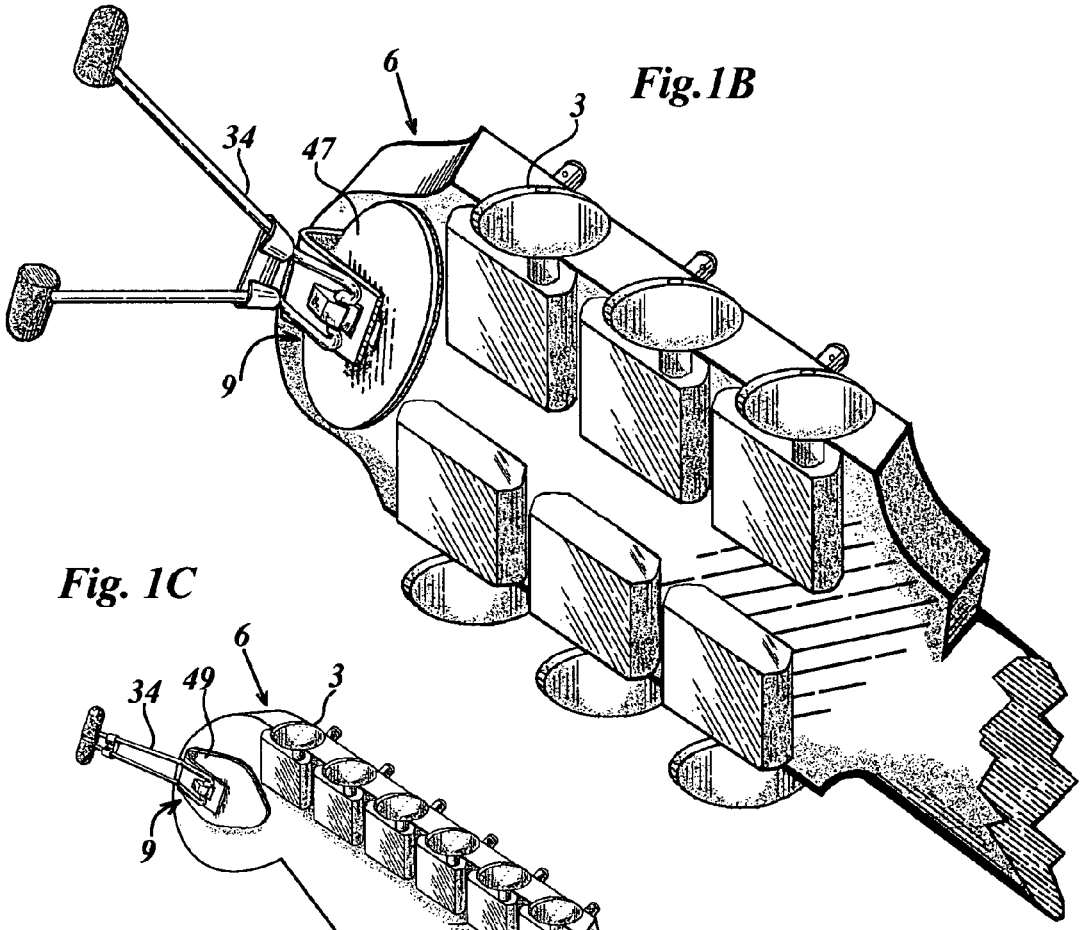
Fig.1B
Fig. 1C
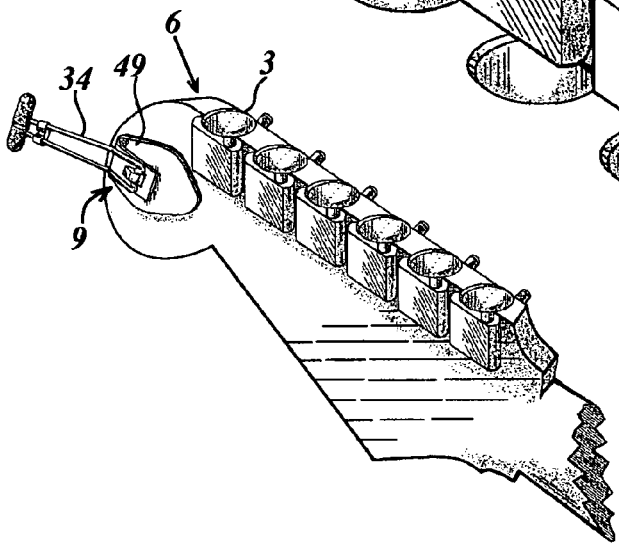

MULTIFUNCTIONAL HEADSTOCK SUPPORT FOR STRING INSTRUMENTS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to stringed musical instruments, and specifically to a unique accessory that attaches to the back side of an instrument's headstock providing a readily available means for supporting and stabilizing the string instrument when it's placed in either a reclined or inclined position.

2. Prior Art

Many types of stringed instrument stands have been developed for guitars, banjos, mandolins, and the like that support an instrument in an upright position when not being played. These stands are relatively cumbersome to move around and transport, some quite rickety, most take up lots of floor pace, and they are seldom readily at hand when the player wants to put the instrument down briefly, so often the instrument is just propped precariously against something or placed on the floor or a table; either or both of which ultimately results in tuning knob bumps and/or tuning machine and instrument damage from inevitable slips and falls, plus causing many annoying out-of-tunes.

Accordingly, addressing part of this problem is U.S. Pat. No. 5,197,701 to Olson (1993) describes a guitar stand that attaches mechanically to the back side of the instrument's sound box. Such an attachment would present an awkward imposition a musician would find hard to overcome, would mar an instrument's fine finish, and would alter the tonal quality of the sound box. U.S. Pat. No. 6,747,197 B2 to Kellogg (2004) describes an instrument stand with an "L"-shaped bracket that attaches to the strap lug on the sound box of a guitar. Again, such an attachment with members projecting from the back of the sound box would present an awkward imposition a musician would find hard to overcome. Plus, this device does not provide any head support or tuning machine or knob protection when the instrument is placed horizontally on its back for any reason, but would actually enhance the probably of inevitable machine knob bumps because the instrument's box section is furthered tilted by the attached apparatus thereby further decreasing the planar surface-to-tuning knobs clearance.

Addressing the problem with focus on the other end of the instrument's structure is U.S. Pat. No. 3,329,054 to Fullaci (1965) that shows a device that mechanically attaches to an instrument's headstock. This device is without question a bulky appendage designed to be fixedly screwed to the headstock of a musical instrument. This marring would be difficult and expensive to correct in a wooden headstock, and near impossible in a synthetic piece. Its shape and prominent projection lend it to be an attachment that would make casing the instrument difficult since most cases are costumed for an instrument and have limited excess room. Additionally, a major shortcoming of this inventions is it's limitation—only a few, flathead styles of guitars have sufficient longitudinal clearance between the tuning machines on the back of the headstock to accommodate the attachment of the device, and many modern styles have no longitudinal clearance at all due to the staggered positioning of the machines on narrow headstocks.

U.S. Pat. No. 6,600,096 to Jarvis (2003) shows a plastic tuning knob protector that clips onto the headstock with a U-shaped bracket gripping front and back surfaces. Again, there is the same longitudinal limitation as with the before referenced patent; additionally, this device is inadequate for instruments with all six tuning machines positioned along one longitudinal periphery—top or bottom—of the headstock, or instruments with uniquely curved frontal nose sections such as are many modern styles Additionally, though made of plastic, the clipping/gripping U-shaped bracket will inevitably produce blemishes to the instrument's finish, especially in polished wooden headstocks which are prone to easy marring. Furthermore, the bracket and its sleeve components hide the keys, which are often expressly designed for eye-catching appeal; plus, cover or blot one of the instrument's main alluring features: the manufacturers emblematic name which is usually inscribed on the headstock's face.

In conclusion, although both of the recited patents do offer tuning machine protection when an instrument is in a horizontal position, neither of them provides any instrument support or stability for when the instrument is placed in a reclined position as when leaned against a vertical structure such as a wall, etc.

OBJECTS AND ADVANTAGES

Accordingly, it is an object of the present invention to provide a multifunctional headstock support that's functional for either a reclined or an inclined position support for stringed musical instruments that is customized to fit all types of string instrument headstocks.

Another object of the present invention is to provide a multifunctional headstock support for string instruments that is designed for non-marring attachment to the back side of an instrument's headstock where it is always and immediately present for the innumerable times a player places an instrument on its back or quickly lean or prop it against something in an inclined position.

Yet another object of the present invention is to provide a multifunctional headstock support for string instruments that is not just functional but which is an aesthetically appealing accessory.

Still another object of the present invention is to provide a multifunctional headstock support for string instruments that includes the capability to fold discreetly against the back side of the headstock in a virtually unnoticeable position if the musician so desires, or for casing, or for hanging the instrument in a wall rack.

Other objects and advantages of the present invention will become apparent from the following detailed description and drawings.

SUMMARY OF THE INVENTION

Preferred Embodiment

In accordance with the present invention, a multifunctional headstock support for string instruments comprises a first constituent defining an anchorage base that attaches to a back side portion of a string instrument's headstock using a non-marring, resoluble adhesive means. A hingedly-coupled second constituent forms a suspended sub-support appendage comprising an elongated support member having one or more elongated support legs with slip resistant buffers which supports and stabilizes the instrument in either a reclined or inclined position.

BRIEF DESCRIPTION OF DRAWINGS

FIGS. 1A, 1B, and 1C show back side perspectives of three geometrically varied multifunctional headstock supports attached to headstocks.

DRAWINGS

Numeral Index

| | |
|---|---|
| 3 | tuning machine knobs |
| 6 | instrument's headstock |
| 9 | multifunctional headstock support |
| 10 | anchorage base |
| 12 | upper plate section |
| 14 | flexible lower limb |
| 16 | keyway cutouts |
| 18 | hooked-recess hinge notch |
| 20 | key shank |
| 22 | flat head |
| 24 | coupling key/hinge pin |
| 26 | roll-over nubs |
| 27 | rounded roll-over nubs |
| 28 | hinge bar |
| 29 | roll-over nubs |
| 30 | mainspring section |
| 32 | variable-positioning slide adjuster |
| 34 | unipod/bipod support leg module |
| 36 | slip-resistant leg buffers |
| 38 | key's bottom end |
| 40a and 40b | support legs |
| 40c and 40d | telescopic support legs |
| 42 | elbow bends |
| 44 | leg retainers |

-continued

| | |
|---|---|
| 46 | slip-resistant, rubber dip covering |
| 47 | custom-designed anchorage base |
| 48 | custom-designed anchorage base |
| 49 | custom-designed anchorage base |
| 50 | double-sided mounting tape disk |
| 52 | double-sided mounting tape strip |
| 53 | adhesive component |
| 56 | modified mainspring member |
| 57 | modified mainspring member |
| 58 | anchorage base |
| 60 | singular support leg |
| 61 | singular support leg |
| 62 | slip-resistant leg buffer |
| 63 | roll-type hinge joint |
| 64 | cutout hinge slot |
| 66 | meshing inner cross sections |
| 68 | retainer pins |
| 70 | retainer pin hole |
| 71 | leg insertion holes |
| 72 | retainer pin holes |
| 74 | soldered-in-place crossbar |
| 76 | rectangular short section |
| 78 | plastic anchorage base |
| 80 | molded-in hinge knuckles |
| 81 | novelty design |
| 82 | conventional hinge knuckles |
| 83 | novelty design |
| 84 | magnetic base plate |
| 86 | fabricated instrument headstock |
| 90 | support module receptacle |
| 91 | unitary support module |

DETAILED DESCRIPTION OF PREFERRED EMBODIMENT

Figure 3B:
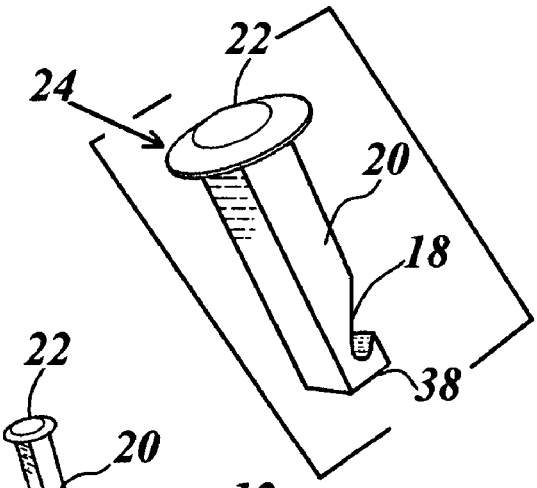
FIG. 3B is a close-up view of combination coupling key/hinge pin.
Figure 3A:
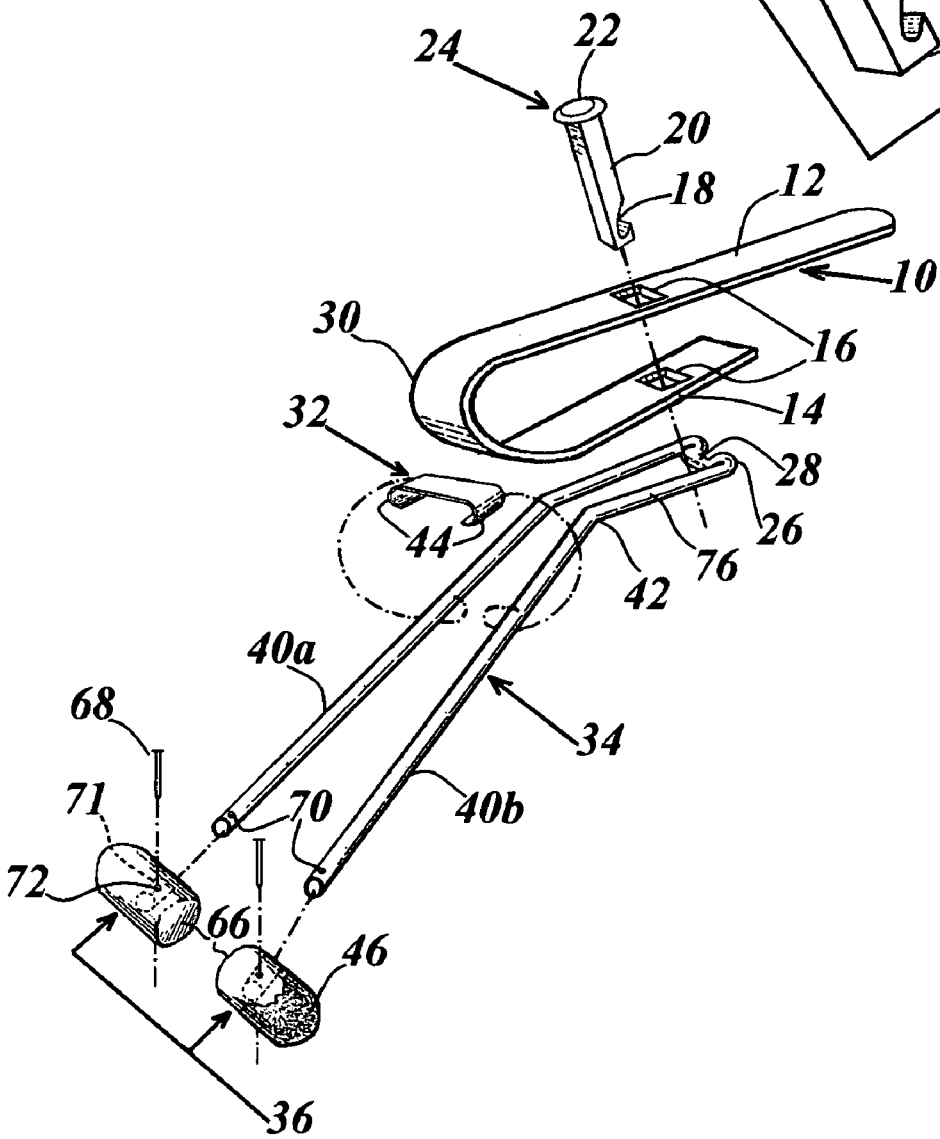
FIG. 3A is an exploded side perspective of the preferred embodiment.
Figure 4:
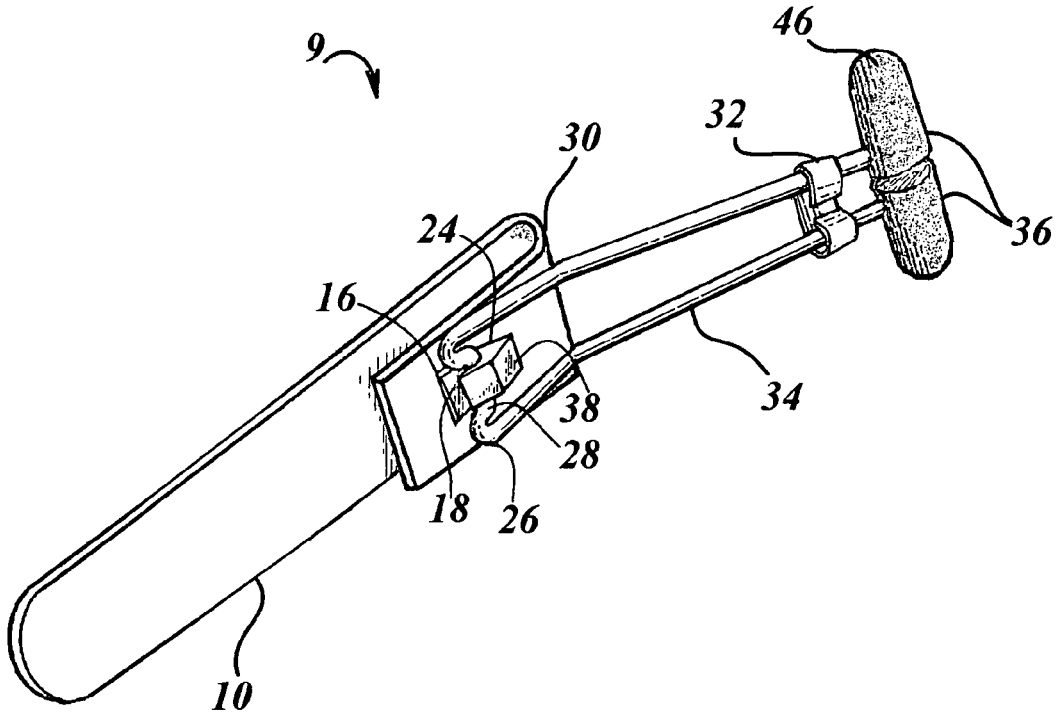
FIG. 4 is a labeled underside view of an assembled unit.

A preferred embodiment of my multifunctional headstock support 9 is illustrated in FIG. 3A that specifically details a first constituent anchorage base 10 with a unipod/bipod support leg module 34 forming a sub-support appendage.

First constituent anchorage base 10 is a mounting plate made of thin, spring metal, and is provided with a unitary mainspring section 30 having a horseshoe-bend 180 degree return. The mounting plate's basic dimensions, its geometric shape, mainspring design, and the material used are totally customizable for adequate fitting to the headstock of the instrument a support is made for FIGS. 1A, 1B, and 1C.

Horizontally oriented, two juxtaposed sections project rearward from the properly formed mainspring section 30: an upper plate section 12 which forms the anchorage base contact plate and a resilient, flexible, lower limb 14 approximately 2.54 cm (about 1 in.) long to it's perspective termination.

The preferred embodiment utilizes duplicate, angular-shaped cutouts. For this design "rectangular" keyway cutouts 16 each approximately 3×5 mm (⅛ by 3/16ths. in.) were used. One keyway cutout 16 is centered cross section-wise in the lower limb 14 with its longest dimensioned cut edges running parallel with the limb's length and about 5 to 6 mm (about ¼ in.) inboard of the limb's terminating end. A second identical keyway cutout 16 is situated in the upper plate section 12 in correlation directly above the lower keyway cutout 16 creating a straight-through lineup.

Referring now to FIG. 3B (close-up); an angular-shaped combination coupling key/hinge pin 24 is fashioned from common ¼ in. steel rod stock available at most hardware stores. Working with a 16 mm (⅝ths. in.) length of rod material, the rod's length is contoured to form a rectangular-shaped key shank 20 that replicates the distinctive shape of the two rectangular keyway cutouts 16 made in upper plate section 12 and lower limb 14; however, the side dimensions of key shank 20 are tailored minutely smaller to facilitate an unimpeded insertion through the two vertically aligned keyway cutouts 16. Additionally, coupling key/hinge pin 24 is furthered tailored with a thinly flattened head 22, and about 5 to 6 mm (about ¼ in.) up the longitudinal axis from key's bottom end 38, a hooked-recess hinge notch 18 is crosscut at 90 degrees across a pre-selected rearward side.

A second constitute, the sub-support appendage forming an elongated support member, is a combination unipod/bipod support leg module 34 fashioned from a length of spring steel rod approximately 2 mm (1/16th.) diameter by about 15.24 cm (about 6 ins.) long available from most metal shops. A series of integral 90 and 180 degree bends are situated at center of rod forming hinge bar 28 that's 6.35 mm (¼ in.), and twin roll-over nubs 26 projecting rearward about 6 mm (3/16ths. in.), and two juxtaposed parallel branches projecting forward. Duplicate support legs 40*a* and 40*b* are fashioned from the two branches with 22½ to 30 degree double-oblique (sideways and downward) elbow bends 42 situated at a point approximately 16 mm (⅝ths in.) in from the ends of the roll-over nubs 26. Additionally, elbow bends 42 create a dimensionally rectangular short section 76 of support leg module 34 and segregates the two support legs 40*a* and 40*b*. A 1 mm (1/32 in.) retainer pin hole 70 is drilled vertically down through each leg approximately 6 mm (3/16ths. in.) in from the open ends.

A variable-positioning slide adjuster 32 consists of a metal band with approximate dimensions of 1.9 cm (¾ in.) long by 6.35 mm (¼ in.) wide. Each end of band is curled under to create essential leg retainers 44 thus leaving a top surface plane of about 1.27 cm (½ in.) long.

Paired, slip-resistant leg buffers 36 have meshing inner cross sections 66, are equipped with retainer pin holes 72, leg insertion holes 71, and retainer pins 68. Additionally, the leg buffers 36 are booted with a pliable, slip-resistant, rubber dip covering 46. Otherwise, the leg buffers are of no specific dimensions or standardized shape.

Figure 6:
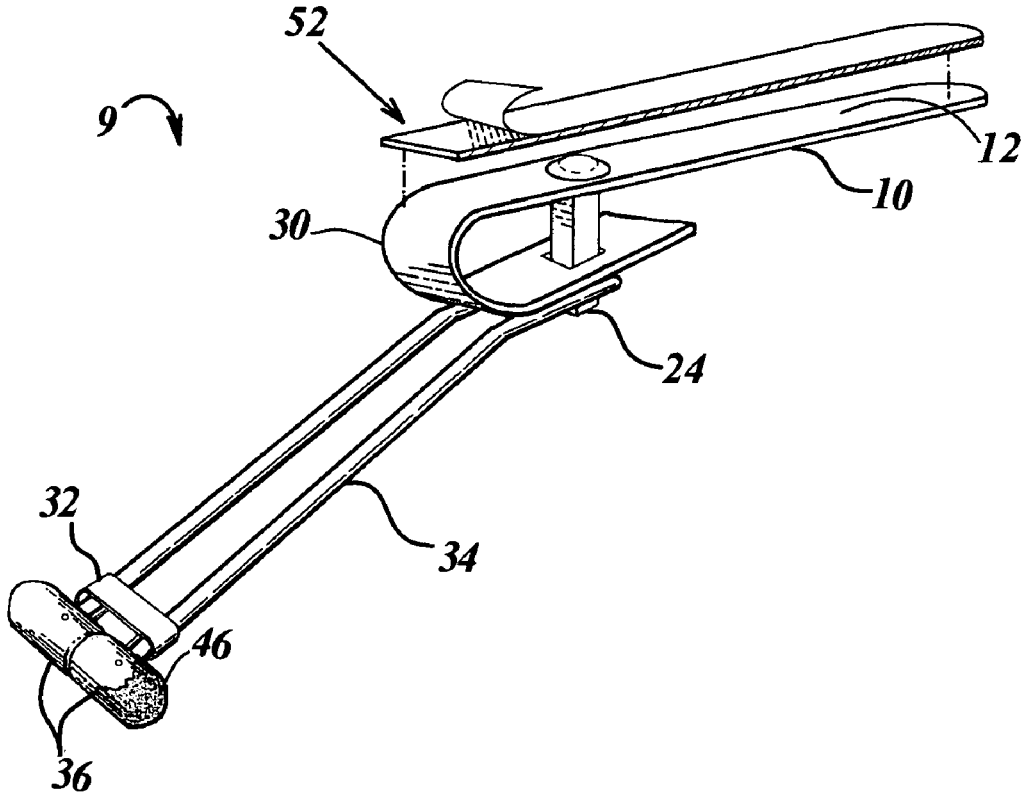
FIG. 6 is a left side perspective showing the unipod position and how a strip of double-sided mounting tape is applied.

As shown in FIG. 6, a double-sided mounting tape strip 52 is tailored to match the top surface plane of long upper limb 12.

Assembly/Operation: P With the anchorage base 10 and the relative components constructed as above described; the combination coupling key//hinge pin 24 is inserted down through the two vertically aligned rectangular keyway cutouts 16. The rectangular shape of key shank 20 of combination coupling key//hinge pin 24 and the complimentary rectangular shape of keyway cutouts 16 should now lock the component in a fixed position. Thus, after the attachment of support leg module 34 this suspended elongated support member can only be manipulated in a fore and aft hinging alternation with minimal rotational play. The hooked-recess hinge notch 18 must be directed rearward away from mainspring section 30. A firm pressure must be applied on lower limb 14 compressing it toward upper plate section 12. This compressing allows hooked-recess hinge notch 18 enough protrusion through the lower keyway cutout 16 to hook and secure hinge bar 28 in hinge notch 18. Support leg module 34 is in proper position if roll-over nubs 26 are directed rearward and support legs 40*a* and 40*b* are extended forward and obliquely downward away from anchorage base 10 component. Mainspring section 30 will maintain a constant expansive pressure against the short rectangular section 76 of support leg module 34 and the roll-over nubs 26 to give the module adequate rigidity to keep it from swinging freely, thereby maintaining the two legs in either extended position (open) or when folded back toward the headstock (closed).

Variable-positioning slide adjuster 32 is clipped loosely onto the individual legs 40*a* and 40*b* utilizing leg retainers 44. Slip-resistant leg buffers 36 are positioned into the insertion holes 71 and secured in place with retainer pins 68 passing into leg holes 70. Secured in place, slip-resistant leg buffers 36 are carefully booted by dipping in a pliable rubber dip 46.

Figure 1A:
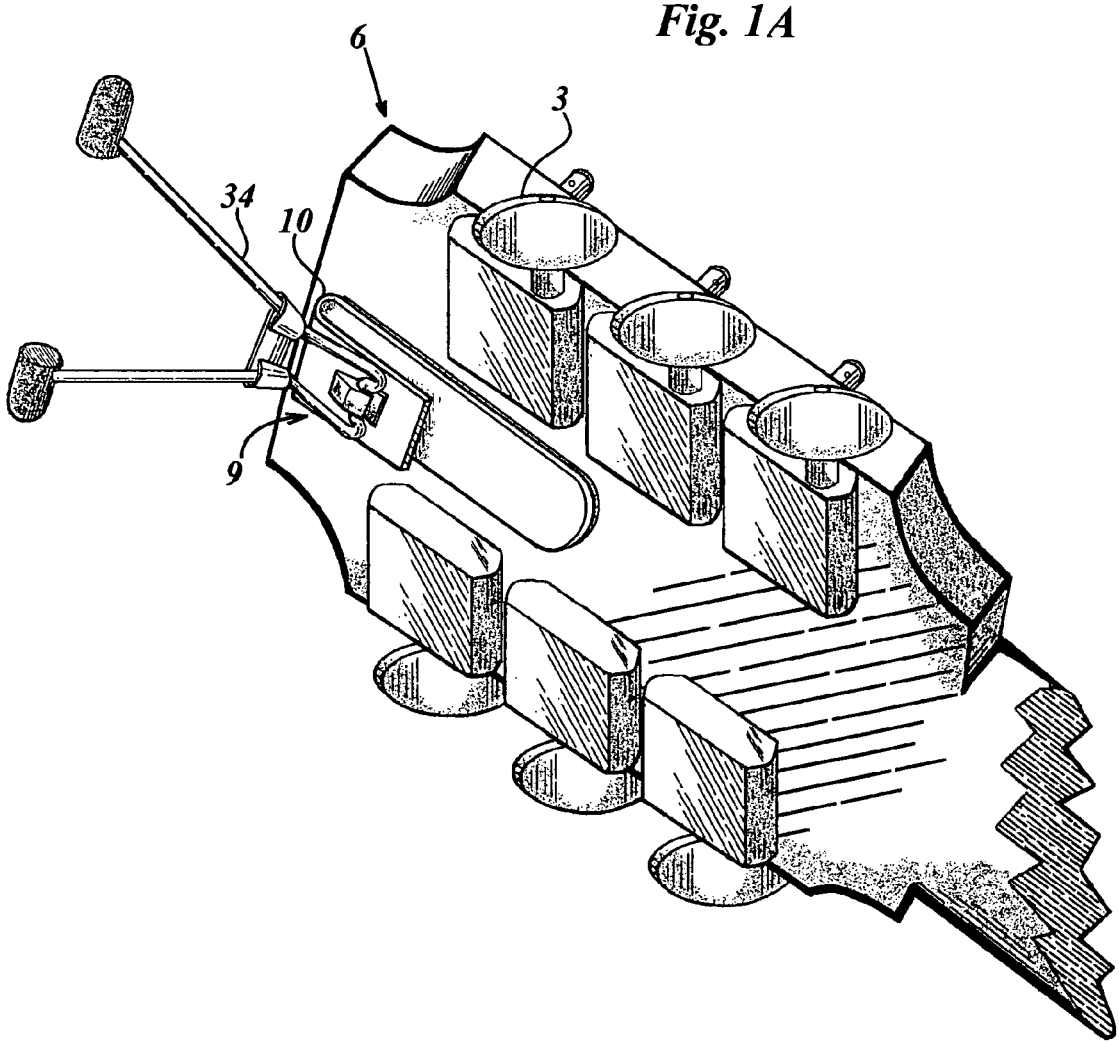
Figure 2A:
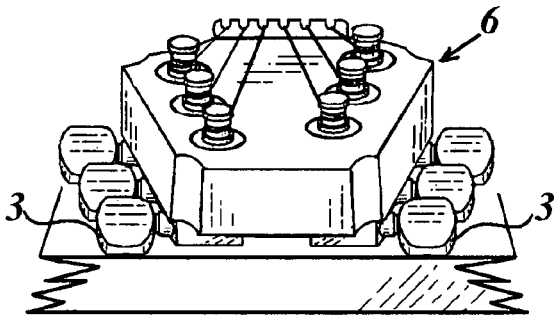
FIGS. 2A-2B show frontal perspectives of before-and-after a headstock support is attached to a headstock.
Figure 2C:
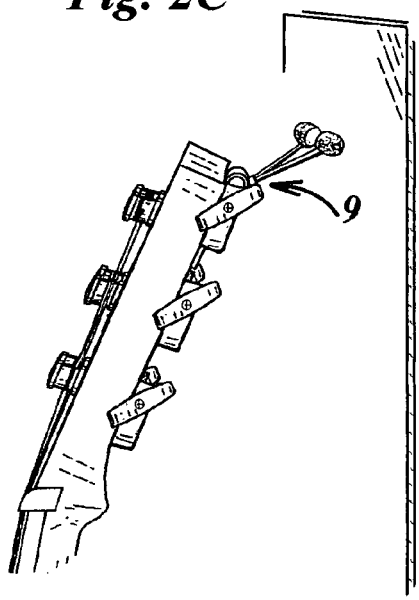
FIG. 2C is a side perspective of instrument in leaning position.
Figure 2B:
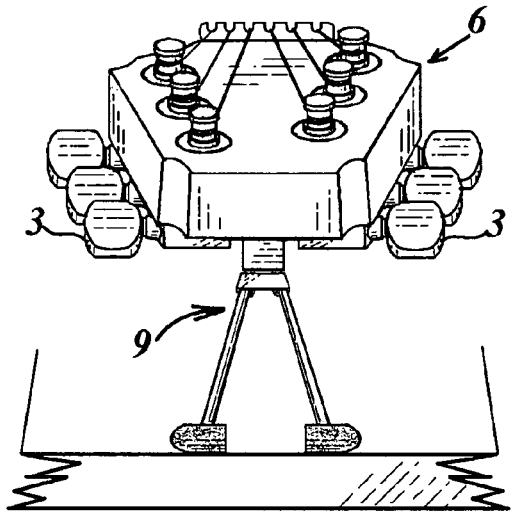
Figure 5:
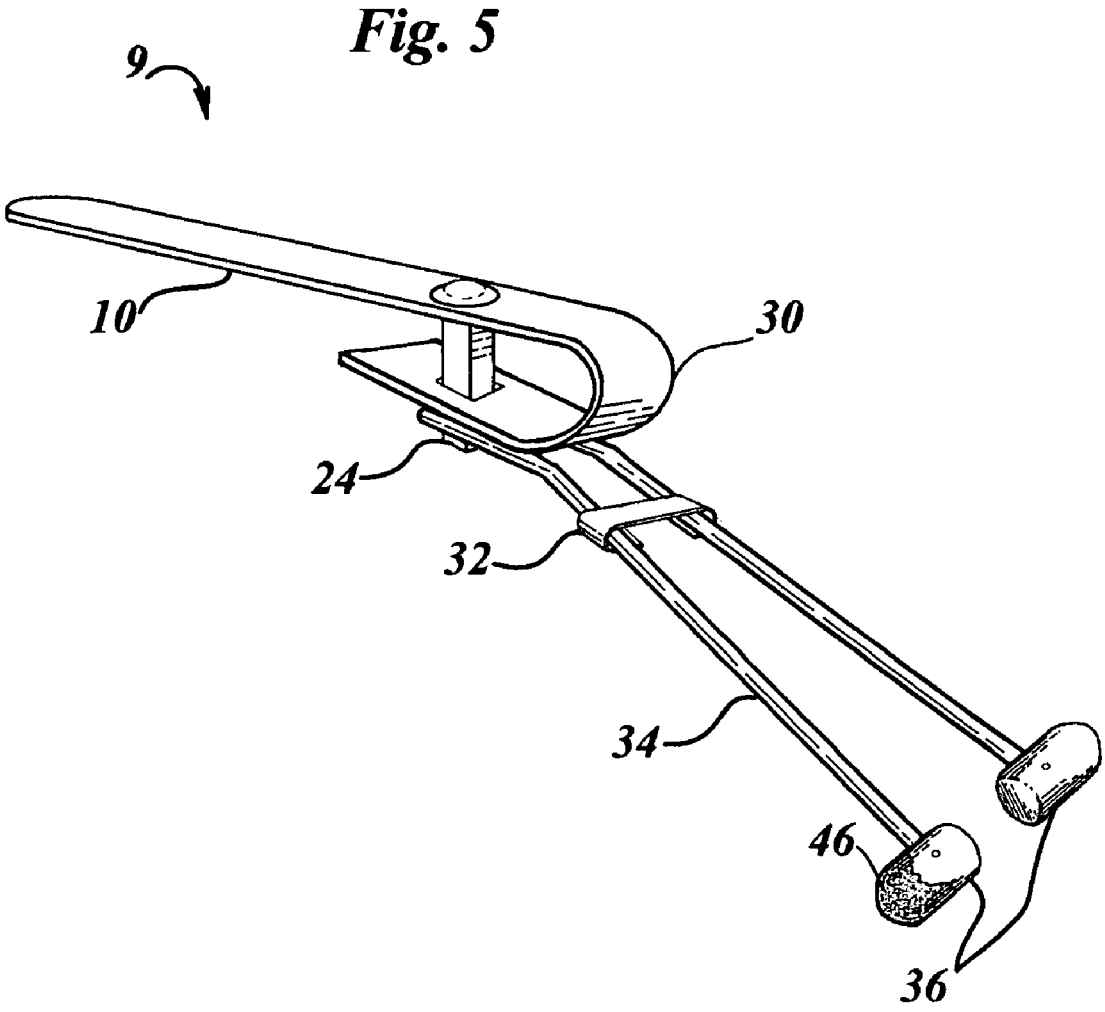
FIG. 5 is a right side perspective showing the bipod position.

In regards to the preferred embodiment, the assembled multifunctional headstock support 9 is now easily attached to the back side of a stringed musical instrument's headstock 6 using the appropriately sized strip of non-marring double-sided mounting tape 52, FIG. 6. The tape strip is affixed to the topmost surface plane of upper plate section 12. The assembled unit is then positioned and affixed to the back side of the instrument's headstock 6 just aft of the frontal edge with the assemblage's mainspring section 30 facing forward as shown in FIG. 1A. The hinged combination unipod/bipod support leg module 34 can now readily be swing forward to its opened position with legs extending, or be folded back toward the headstock in a closed position. Slide adjuster 32 can be easily slid up and down legs 40*a* and 40*b* to position and hold the individual slip-resistant leg buffers 36 at various widths as depicted in FIGS. 5 and 6. The instrument can now be placed horizontally on its back with the headstock resting on the support legs as shown in FIG. 2B with less risk of inadvertent tuning machine knobs 3 being bumped as depicted in FIG. 2A, or it can be more securely propped against a vertical structure such as a wall as shown in FIG. 2C with the associated structural weight of the instrument being supported.

Although my multifunctional headstock support has been described relative to a specific embodiment thereof, there are numerous variations and modifications that will be readily apparent to those skilled in the art in the light of the preceding detailed description. One example being the anchorage base 10, as described, utilizes distinctively-shaped keyway cutouts 16 as essential elements in creating and retaining a stabilized sub-support appendage although other retaining methods such as spot welding or keyway cutouts and coupling keys of other shapes and dimensions, or a coupling pin with knurling ridges will suffice.

Another example being in the use of a variety of materials to achieve the unique structure and function of the present invention without departing from the scope thereof.

Still, another example being in the geometrical designs and aesthetics of the anchorage base, in coupling and hinging techniques, and design of the sub-support appendage and relative components.

Figure 12A:
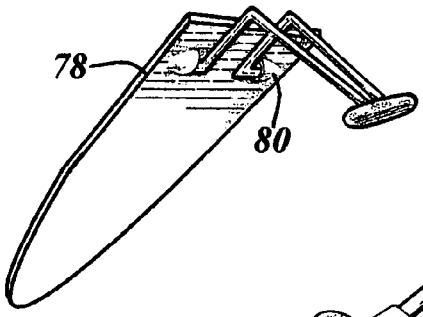
FIGS. 12A-12B-12C show alternative embodiments.
Figure 12B:
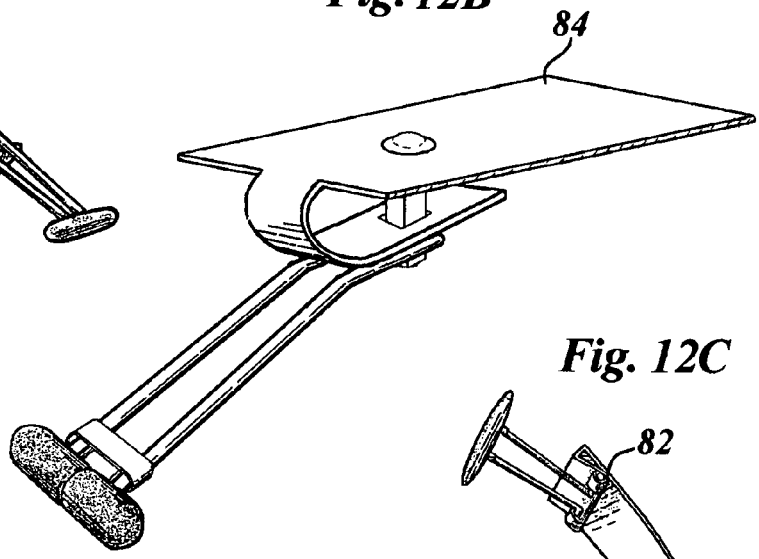
Figure 12C:
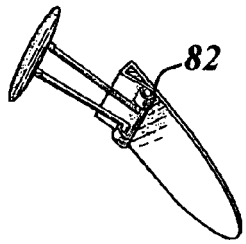
Figure 12D:
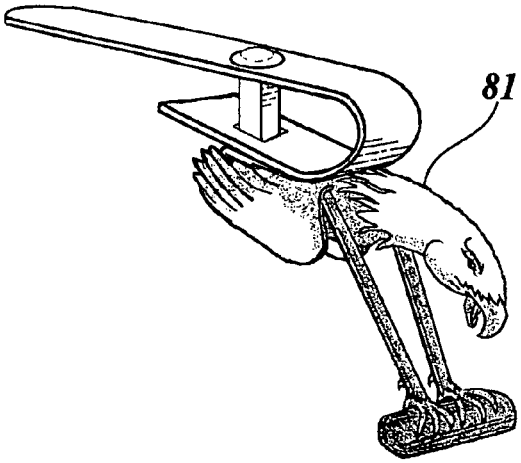
FIGS. 12D-12E show alternative embodiments with novelty designs.
Figure 12E:
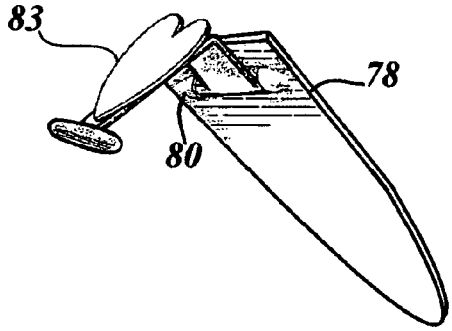

Yet, another example being in the novelty and unique design possibilities of the elongated support member as shown in FIGS. 12D-12E.

Additional Embodiments

Figure 7:
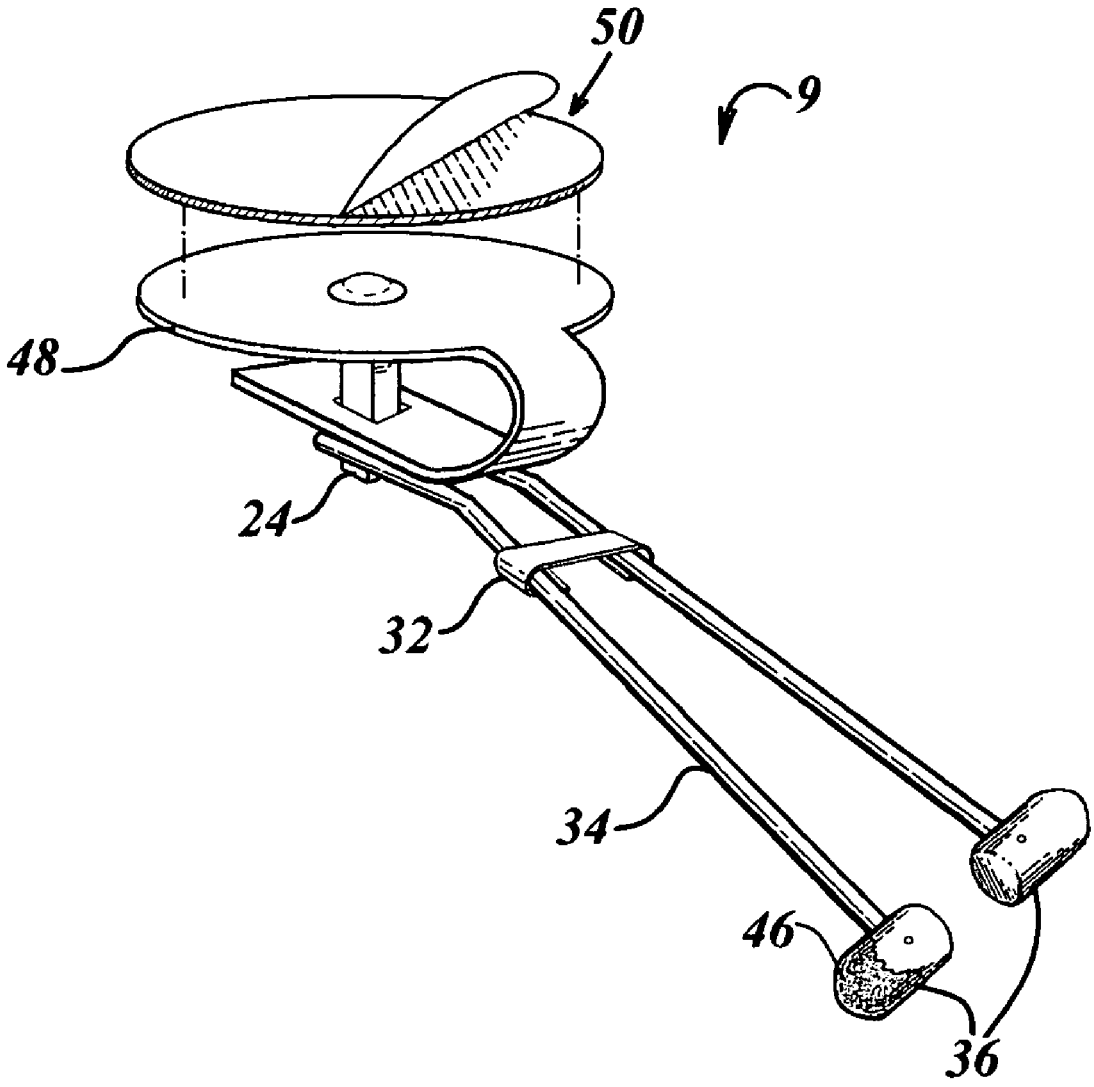
FIG. 7 is for illustrative purposes showing a custom-designed unit and its tailored mounting tape.
Figure 8A:
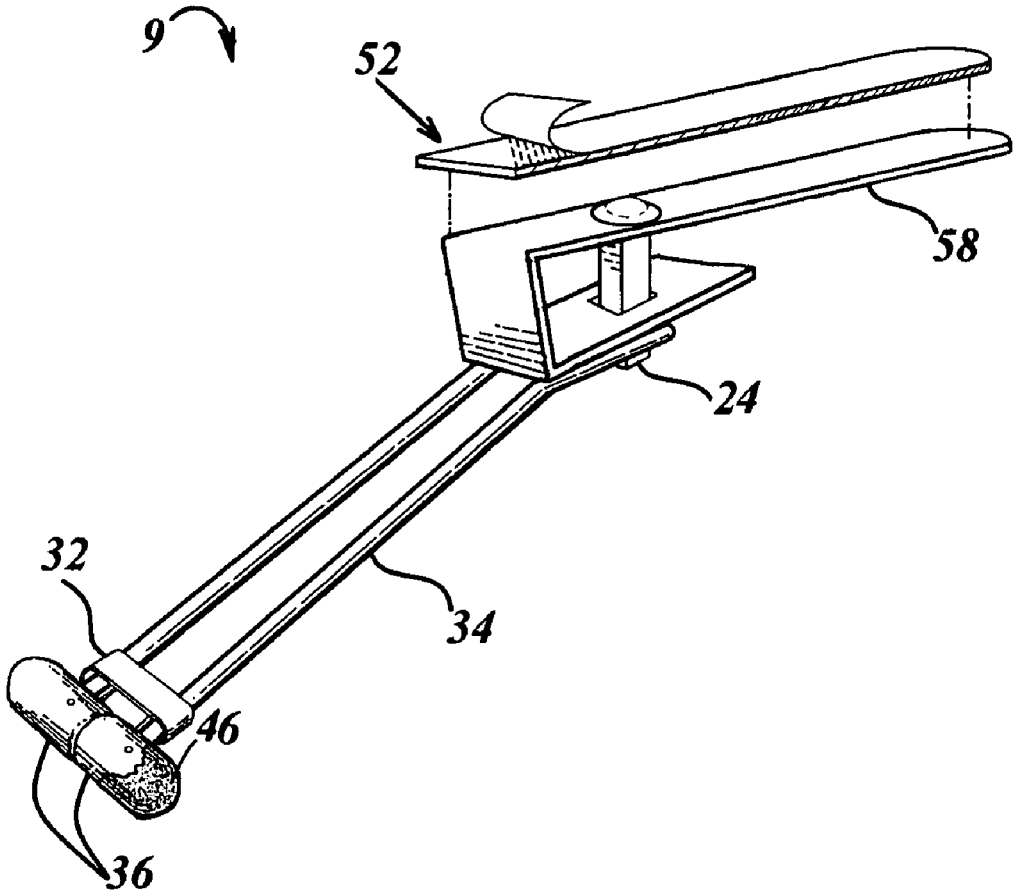
FIG. 8A shows an alternative anchorage base design.
Figure 8B:
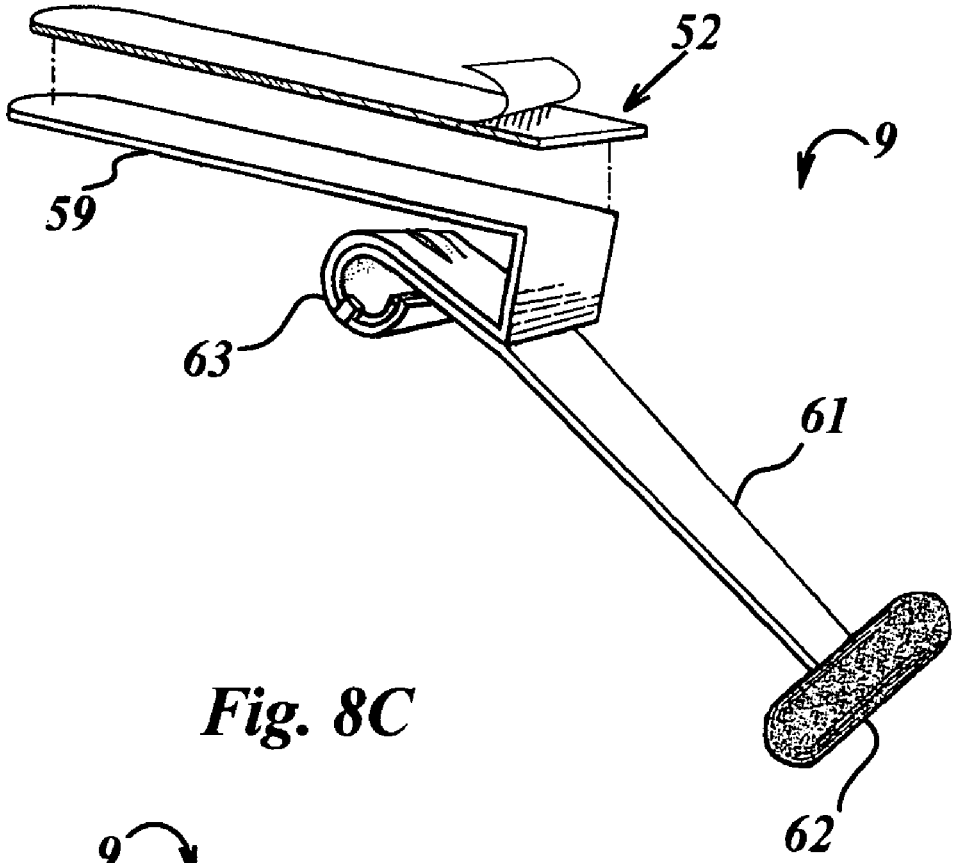
FIG. 8B reveals an alternative hinge design.
Figure 8C:
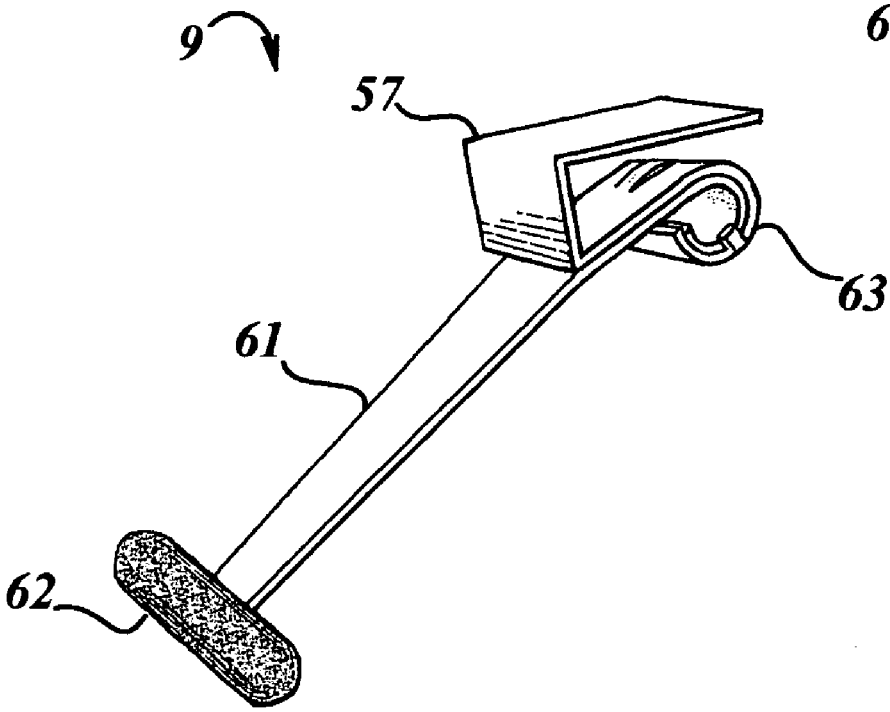
FIG. 8C shows a modified mainspring member.
Figure 9A:
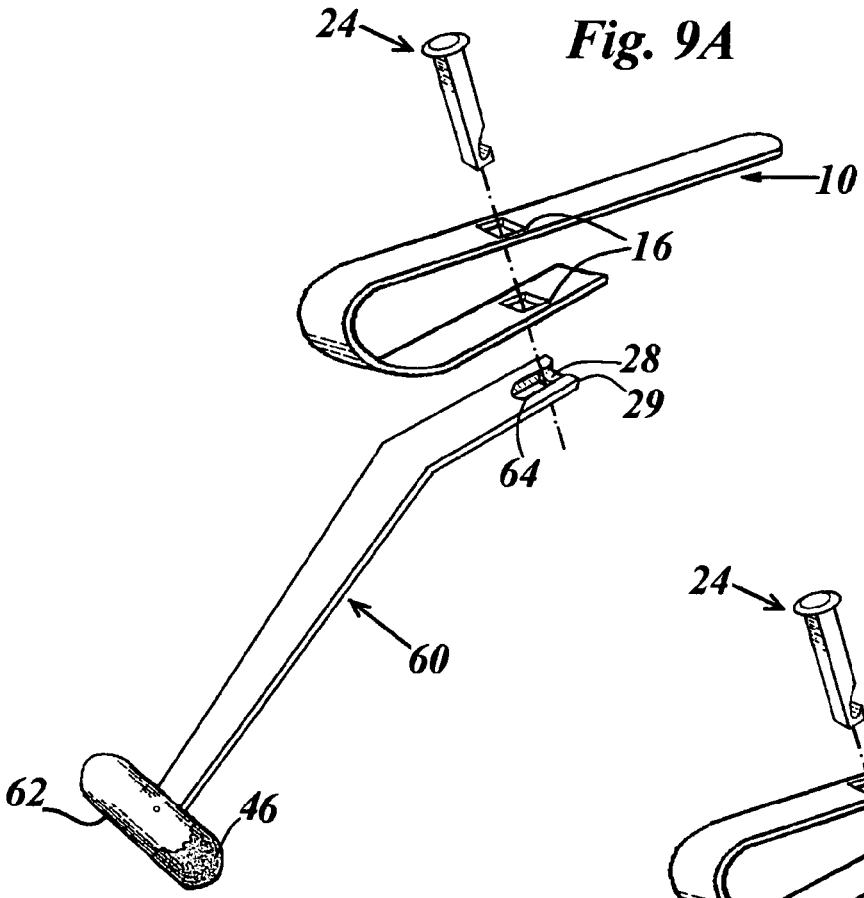
FIG. 9A shows a singular support leg.
Figure 9B:
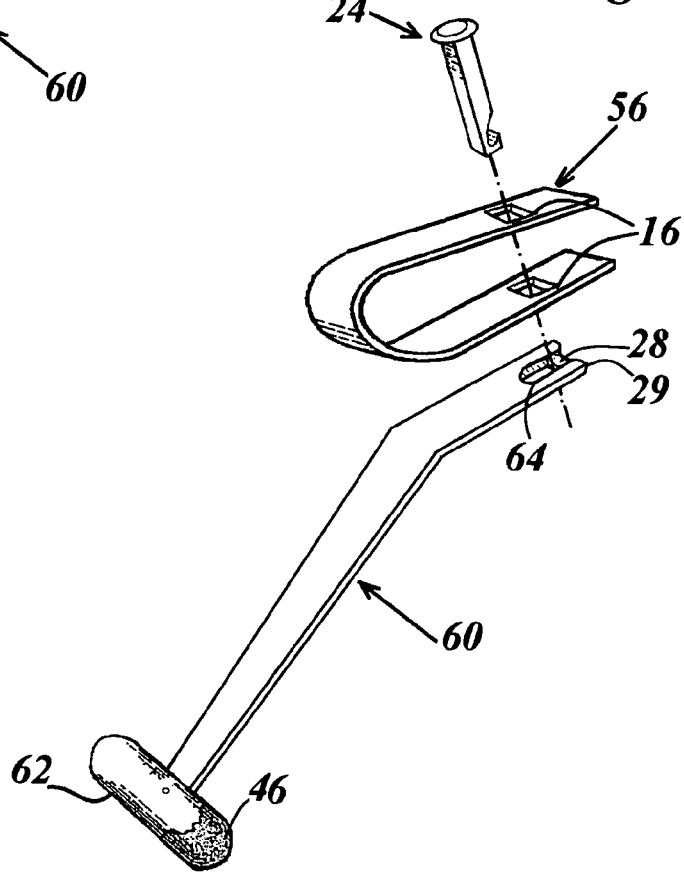
FIG. 9B shows another modified mainspring member.
Figure 10:
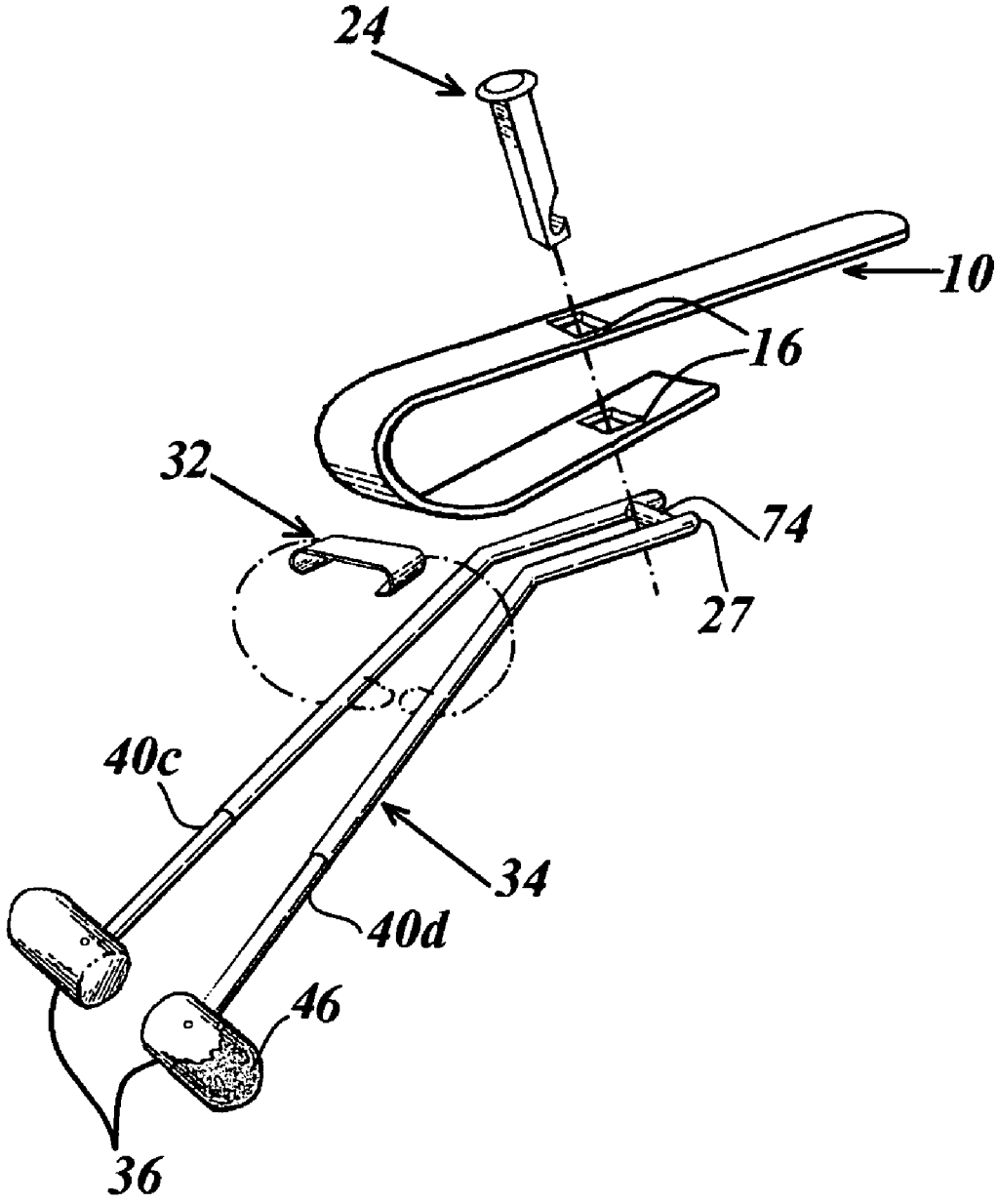
FIG. 10 shows a soldered-in-place hinge crossbar and telescopic extension legs.

Additional embodiments are shown in FIGS. 1B, and 1C; FIG. 7; FIGS. 8A,8B, and 8C; 9A-9B, and FIG. 10. FIGS. 1B, and 1C show multifunctional headstock support 9 having custom-designed anchorage bases 47 and 49. FIG. 7 shows assembled unit with disk-shaped anchorage base 48 and an appropriately tailored double-sided mounting tape disk 50. FIG. 8A shows an anchorage base 58 with a unique boxy-shaped mainspring section. FIG. 8B reveals an alternative hinge junction with interlocked hinge knuckles forming a roll-type hinge joint 63. FIG. 8C is for illustration to show dimensionally modified mainspring member 57. FIG. 9A illustrates a singular support leg 60 with cutout hinge slot 64, hinge bar 28, roll-over nubs 29, and slip-resistant leg buffer 62. FIG. 9B is to illustrate another modified mainspring member 56. And FIG. 10 shows two juxtaposed telescopic support legs 40*c* and 40*d* that are extendable, a soldered-in-place crossbar 74 and rearward projecting, rounded roll-over nubs 27.

Alternative Embodiments

Figure 11A:
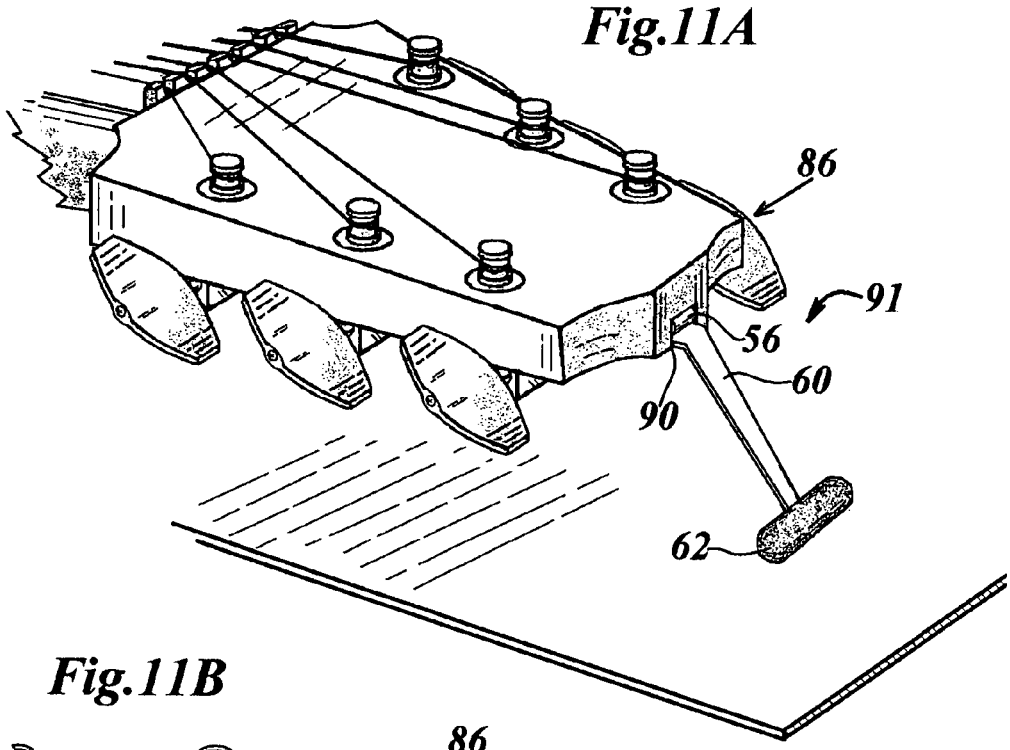
FIGS. 11A-11B-11C show a headstock with unitary support module receptacle.
Figure 11B:
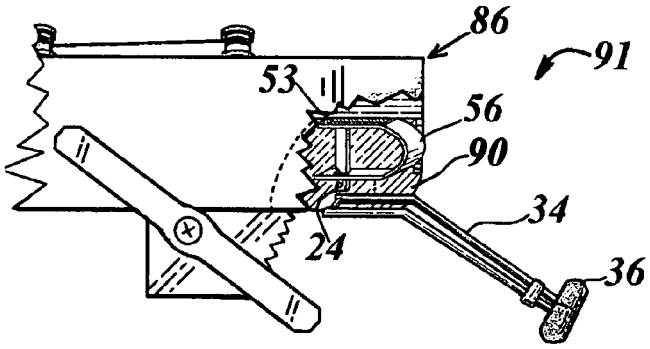
Figure 11C:
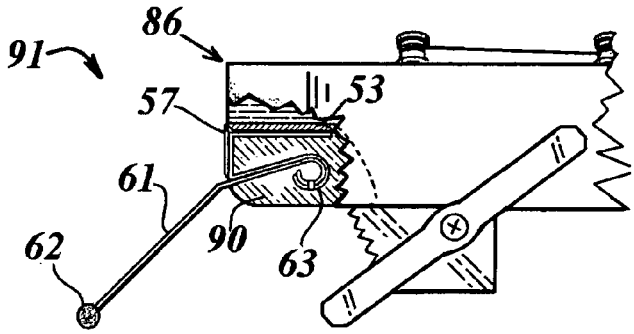

Alternative embodiments are shown in FIGS. 11A-11B, which show and detail a first constituent anchorage base being a fabricated instrument headstock 86 having a materially built-in unitary support module receptacle 90. Receptacle 90 being basically a longitudinal channel, a groove, or otherwise fabricated compartment in or communicating with the back side of the headstock designed for the internal housing of a unitary support module 91, and which imparts unimpeded fore-and-aft hinging alternation of same. FIG. 11A shows a unitary support module 91 comprising modified mainspring member 56 and singular support leg 60 (coupling key//hinge pin 24 is not visible.) FIG. 11B shows the use of unipod/bipod module 34, modified mainspring member 56, and coupling key//hinge pin 24. FIG. 11C shows modified mainspring member 57, and the coupling of singular support leg 61 using hinge joint 63. The unitary support module is secured in position within the support module receptacle 90 with adhesive component 53.

FIGS. 12A-12C show custom-designed anchorage bases employing a more conventional hinge knuckles 82 design; FIG. 12B shows a magnetic base plate 84 for magnetic attachment to the tuning machine housings. Additionally, FIGS. 12A-12E show a plastic anchorage base 78 with molded-in hinge knuckles 80. FIGS. 12D and 12E are for illustrative purposes to show two novelty designs 81 and 83 of the numerous possibilities for such.

ADVANTAGES

Accordingly, the reader will see that my above described multifunctional headstock support is a resolution to a long-felt but heretofore unsolved need shared by musicians for their stringed instruments. Additionally, the non-marring mounting tape attachment design is vital to preserving the finish of the instrument. Plus, the accessory can be just as easily removed as it is attached, thus leaving no screw holes or ugly scars.

Also, the hinged elongated support member folds back neatly against the headstock for easy casing or when hanging the instrument in a wall hanger. And when support member is in open position it provides a sturdy tabletop headrest when re-stringing an instrument.

Additionally, the present invention may be easily modified to provide an ergonomic support for portable keyboards and organs.

Furthermore, the present invention can be conveniently attached and utilized for the ergonomic positioning of laptop and notebook computers and other small desktop appliances.

Although the description above contains many specificities, these should not be construed as limiting the scope of the invention but as merely providing an illustration of some of its presently evaluated embodiments.

Thus the scope of the invention should be determined by the claims and their legal equivalents rather than by the examples given.

I claim:

1. A multifunctional headstock support for a string instrument:

guitar, banjo, mandolin or the like, comprising:

(a) a first constituent defining an integral anchorage base, said anchorage base having means for secure attachment to the back side of said headstock of said string instrument, thereby providing an integral anchorage means for the unitary coupling of said first constituent and a hingedly suspended sub-support appendage, (b) a second constituent forming said sub-support appendage hingedly suspended from said first constituent, said sub-support appendage comprising an elongated support member having one or more elongated support legs.

2. A multifunctional headstock support for a string instrument:

guitar, banjo, mandolin or the like, comprising:

(a) a first constituent forming an anchorage base comprising a mounting plate, said mounting plate having means for direct attachment to the back side of said headstock of said string instrument, thereby defining an integral anchorage means for the coupling together of said first constituent and a hingedly suspended sub-support appendage, b) a second constituent defining said sub-support appendage hingedly suspended from said anchorage base, said sub-support appendage being an elongated support member comprising one or more elongated support legs and having sufficient robustiousness to sustain the associated weight of said string instrument when said instrument is placed in either a reclined or inclined position, (c) means for joining said sub-support appendage with said anchorage base to facilitate a principally fore-and-aft hinging and folding alternation of said elongated support member, (d) means for non-marring attachment of said multifunctional headstock support with said back side portion of said headstock.

3. The multifunctional headstock support of claim 2 wherein said anchorage base further comprises a unitary mainspring.

4. The multifunctional headstock support of claim 2 wherein said anchorage base is made from a sufficiently resilient material such as a spring metal.

5. The multifunctional headstock support of claim 2 wherein said anchorage base is made from a sufficiently resilient material such as plastic.

6. The multifunctional headstock support of claim 2 wherein said sub-support appendage is an elongated support member comprising a singular elongated support leg.

7. The multifunctional headstock support of claim 2 wherein said sub-support appendage is an elongated support member comprising a combination unipod/bipod support leg module having relative slip-resistant leg buffers.

8. The multifunctional headstock support of claim 7 wherein said combination unipod/bipod support leg module is equipped with a variable-positioning slide adjuster slidably affixed to said support legs.

9. The multifunctional headstock support of claim 2 wherein said sub-support appendage is an elongated support member comprising a combination unipod/bipod support leg module having telescopic support legs with relative slip-resistant leg buffers.

10. The multifunctional headstock support of claim 2 wherein said means for joining is a hinge joint comprising a hinge knuckle.

11. The multifunctional headstock support of claim 2 wherein said means for joining is a hinge conjunction comprising a plurality of hinge knuckles.

12. The multifunctional headstock support of claim 2 wherein said means for joining comprises a combination coupling key/hinge pin and further including a hooked-recess hinge notch to accommodate coupling of said elongated support member.

13. The multifunctional headstock support of claim 2 wherein said means for joining further comprises a plurality of keyway cutouts in said anchorage base to facilitate insertion of said combination coupling key/hinge pin.

14. The multifunctional headstock support of claim 2 wherein said means for non-marring attachment to the back side of said headstock of said string instruments is a resoluble adhesive layer on a topmost surface of said anchorage base.

15. The multifunctional headstock support of claim 14 wherein said resoluble adhesive layer is double-sided mounting tape.

16. A multifunctional headstock support for string instruments, comprising:

(a) a first constituent defining an anchorage base, said anchorage base being a fabricated instrument headstock wherein said headstock has a unitary support module receptacle fabricated into back side of said headstock, and (b) a second constituent defining a unitary support module comprising a mainspring member and hingedly coupled sub-support appendage.

17. The multifunctional headstock support for string instruments of claim 16 wherein said unitary support module receptacle is sufficiently dimensioned to accommodate the internal housing of said unitary support module and to facilitate fore-and-aft hinging alternation of said sub-support appendage.

18. The multifunctional headstock support of claim 16 wherein said sub-support appendage is an elongated support member comprising a singular support leg.

19. The multifunctional headstock support of claim 16 wherein said sub-support appendage is an elongated support member comprising a combination unipod/bipod support leg module, whereby said string instrument has a multifunctional accessory that provides an elevated headstock support when placed horizontally on its back, thus protecting the tuning machines from accidental bumps, or a handy instrument support when the instrument is placed in an inclined position against a vertical structure such as a wall.

* * * * *